United States Patent [19]

Akino

[11] Patent Number: 4,789,044

[45] Date of Patent: Dec. 6, 1988

[54] NARROW DIRECTIONAL MICROPHONE

[75] Inventor: Hiroshi Akino, Sagamihara, Japan

[73] Assignee: Kabushiki Kaisha Audio-Technica, Tokyo, Japan

[21] Appl. No.: 931,649

[22] Filed: Nov. 17, 1986

[30] Foreign Application Priority Data

Nov. 19, 1985 [JP] Japan ..... 60-259187

[51] Int. Cl.[4] ..... H04R 1/20

[52] U.S. Cl. ..... 181/158; 181/196; 181/242; 381/154; 381/155; 381/169; 381/188; 381/205

[58] Field of Search ..... 181/158, 175, 196, 198, 181/242; 381/168, 177, 205, 154, 155, 169, 188

[56] References Cited

U.S. PATENT DOCUMENTS

| | | | |
|---|---|---|---|
| 2,210,415 | 8/1940 | Kellogg | 381/154 X |
| 2,789,651 | 4/1957 | Daniels | 381/168 |
| 3,082,298 | 3/1963 | Gorike | 381/155 |
| 3,095,484 | 6/1963 | Beaverson et al. | 181/158 X |
| 3,444,955 | 5/1969 | Hoffmann | 181/158 |
| 3,560,668 | 2/1971 | Warning | 181/158 X |
| 3,989,905 | 11/1976 | Anderson et al. | 381/177 X |
| 4,264,790 | 4/1981 | Zlevor | 381/155 |
| 4,340,787 | 7/1982 | Gorike | 381/155 |
| 4,363,937 | 12/1982 | Bruna | 381/155 |

FOREIGN PATENT DOCUMENTS

| | | |
|---|---|---|
| 1522906 | 4/1968 | France . |
| 23957 | 5/1977 | Japan . |

*Primary Examiner*—Benjamin R. Fuller
*Attorney, Agent, or Firm*—Welsh & Katz, Ltd.

[57] ABSTRACT

A narrow directional microphone comprising a microphone unit having forward and rearward sound terminals, and an interference pipe to cooperate with said microphone unit and to effect a narrow directional orientation. The microphone unit is positioned at its outer periphery to take a position at a distance to an inner periphery of the interference pipe in a rear end of the interference pipe. The interference pipe having a plurality of sound wave inlets at a distance in a circumferential direction at a portion taking position on said rearward sound terminal of said interference pipe.

7 Claims, 1 Drawing Sheet

NARROW DIRECTIONAL MICROPHONE

FIELD AND BACKGROUND OF THE INVENTION

This invention relates to a narrow directional microphone, more particularly a proximity effect improvement in the narrow directional microphone having a microphone unit and an interference pipe.

It is conventionally tried to narrow a directional orientation by attaching an interference pipe at a tip end of a directional microphone unit. In such narrow directional microphone, a monodirectional microphone having a forward audio sound terminal and a rearward audio sound terminal is used, and one end of the interference pipe is mated to the forward audio sound terminal, and the rearward audio sound terminal is positioned at a free audio sound field. By this arrangement considerably narrow directional orientation is obtained, but it has a defect and drawback that it picks up wind noise etc., and raises a proximity effect which distorts a low band area when the sound source is near. This happens because the sound wave introduction inlet of the forward audio sound terminal becomes the tip end of the interference pipe, and the effective distance between the forward audio sound terminal and the rearward audio sound terminal becomes longer.

SUMMARY OF THE INVENTION

An object of this invention is to provide a narrow directional microphone to lower the wind noise and the proximity effect by a simple construction in the directional microphone having a directional microphone unit and an interference pipe.

This invention is characterized in that in a narrow directional microphone having a microphone unit having forward and rearward audio sound terminals, and an interference pipe to cooperate with this microphone unit so as to effect a narrow directional orientation, the microphone unit is positioned in the interference pipe rear end spaced from an inner periphery surface of the pipe to form a gap; a plurality of sound wave introduction inlets are provided on the rearward terminal spaced circumferentially.

BRIEF DESCRIPTION OF THE ACCOMPANYING DRAWINGS

DESCRIPTION OF THE PREFERRED EMBODIMENTS

Figure 1:
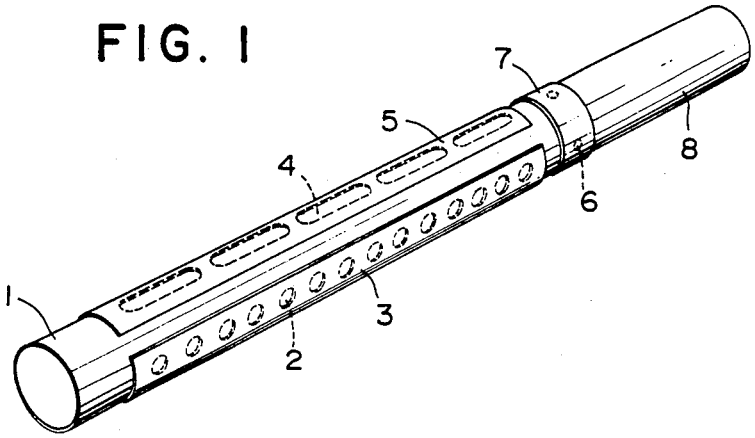
FIG. 1 is a perspective view showing an entirety of a narrow directional microphone according to this invention.
Figure 2:
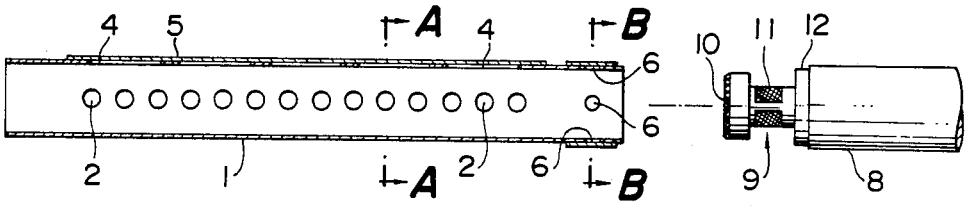
FIG. 2 is a plan view showing a view separating an interference pipe and a grip member.
Figure 3:
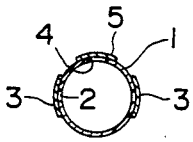
FIG. 3 is a horizontal cross section along a line A—A in FIG. 2.
Figure 4:
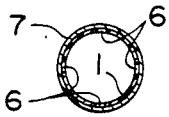
FIG. 4 is a horizontal cross section along a line B—B in FIG. 2.
Figure 5:
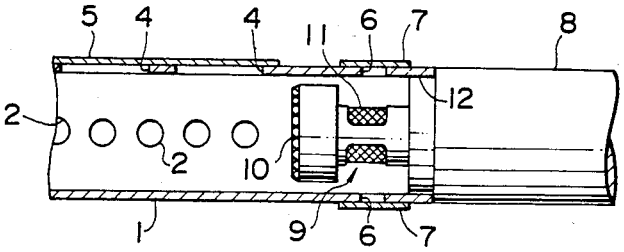
FIG. 5 is a longitudinal cross section showing the connection of the interference pipe and the grip member.

The interference pipe comprising a metal such as aluminum is open at both ends and is provided with a plurality of spaced openings 2 from its tip end to a rear end. An audio sound resistance material 3 comprising a non-woven cloth is affixed to an upper surface of the interference pipe so as to cover an upper face of the openings 2. A plurality of openings 2 are also formed on the pipe spaced 180° in a circumferential direction and on which the audio sound resistance material 3 is also bonded. Elongated holes 4 are also provided on a circumferential face in an axial direction at a distance of 90° in a circumferential direction to this row of the openings 2 and from a tip end to a rear end. A diaphram 5 comprising polyvinylidene fluoride is bonded on an upper face of the interference pipe 1 so as to cover upper faces of these elongated holes 4. These elongated holes 4 and the diaphram 5 prevent resonance in the interference pipe 1 and are for controlling the introductive sound wave and a phase change. A size and its tension are set by a desired phase change and the sound wave introduced from a side portion of the interference pipe 1.

A plurality of spaced sound wave introduction inlets 6 are formed in a circumferential direction at a rear end of the interference pipe 1 and an interference material 7 comprising a non-woven textile such as felt and nylon mesh is attached so as to cover the upper face of the sound wave introduction inlets 6. A tip end of a grip 8 having a switch for operation of the microphone (not shown) is mated at a rear end of the interference pipe 1.

Monodirectional microphone unit 9 is constituted such that its outer periphery is smaller than an inner diameter of the interference pipe 1 and has a forward audio sound terminal 10 and a rearward audio sound terminal 11, and its rear end is attached to a tip end of the grip 8. Formed at a tip end of the grip 8 is an area of reduced diameter 12 to which a rear end of the interference pipe 1 is mated, by which the microphone unit 9 is accomodated leaving a gap or space between its outer periphery and an inner periphery of the interference pipe 1 in a rear end of the interference pipe 1. The sound wave introduction inlet 6 is positioned so as to take position on a face of the rearward audio sound terminal 11 of the microphone unit 9.

Since the microphone unit 9 is contained in the interference pipe 1 as mentioned above, and an audio sound introduction inlet 6 is provided for communicating a free sound field on the rearward audio sound terminal 11 and a gap communicating the forward sound terminal 10 is provided in the interference pipe 1, a distance between the sound terminals at a low area is dominated by a distance between the sound terminals 10 and 11 of the monodirectional microphone unit 9. Furthermore, as the interference pipe 1 works like a wind screen, a wind noise having a major low frequency component vector and proximity effect are diminished. By providing a shutter or sound resistance (not shown) such as felt and the like or by changing an inertance, a sound pressure tilt is changed. By this fact, a medium low orientation is changed to bi-directional, hyper cardiode and cardiode.

The narrow directional microphone according to this invention lowers wind noise and the proximity effect compared to the conventional narrow directional microphone by a very simple construction wherein a directional microphone is inserted in the interference pipe so as to position its outer periphery at a distance to an inner periphery of the interference pipe and the sound wave introduction inlets are provided to the interference pipe taking a position on the rearward sound element of the microphone unit.

What is claimed is:

1. A directional microphone comprising a grip portion, an elongated cylindrical interference pipe, and a microphone unit having a forward sound terminal and a rearward sound terminal spaced from said forward sound terminal;

said interference pipe accommodating said microphone unit wholly within a rear end portion thereof for cooperating with said microphone unit to effect a narrow directional sound orientation of said microphone, said rear end portion being secured to said grip portion;

an inner peripheral surface of said interference pipe being larger than an outer peripheral surface of said microphone unit thereby forming a gap therebetween, a plurality of sound inlets circumferentially spaced on said interference pipe directly over said rearward sound terminal for direct transmission of sound waves to said rearward sound terminal; and a plurality of first openings axially spaced on said interference pipe.

2. A directional microphone according to claim 1, wherein said sound inlets are covered with an interference material comprising a non-woven textile.

3. A directional microphone according to claim 1, further including a plurality of second openings spaced axially on said interference pipe and positioned 90° circumferentially on said interference pipe from a row of said first openings, each of said second openings being longitudinally elongated and covered with a diaphragm.

4. A directional microphone comprising a microphone unit having a forward sound terminal and a rearward sound terminal spaced from said forward sound terminal;

an elongated cylindrical interference pipe accommodating said microphone unit wholly within a rear end portion thereof for cooperating with said microphone unit to effect a narrow directional sound orientation of said microphone;

an inner peripheral surface of said interference pipe being larger than an outer peripheral surface of said microphone unit to form a gap therebetween, a plurality of sound inlets circumferentially spaced on said interference pipe directly over said rearward sound terminal for direct transmission of sound waves to said rearward sound terminal; and a plurality of first openings axially spaced on said interference pipe, said openings comprising a first series of axially spaced openings and a second series of axially spaced openings positioned approximately 180° opposite said first series of openings on said interference pipe.

5. A directional microphone according to claim 4, wherein said sound inlets are covered with an interference material comprising a non-woven textile.

6. A directional microphone according to claim 4, further including a plurality of third openings axially spaced on said interference pipe and positioned 90° circumferentially on said interference pipe from said series of first openings, each of said third openings being axially elongated and covered with a diaphragm.

7. A directional microphone comprising a grip, a hollow elongated interference pipe open at a distal end and secured to said grip at a grip end, a circular microphone unit wholly within a rear portion of said interference pipe and having a forward sound terminal and a rearward sound terminal spaced from each of said forward sound terminal and said grip end;

an area of reduced diameter at an end portion of said grip, said grip end of said interference pipe affixed to said grip over said area of reduced diameter, a gap defined by said interference pipe and said microphone unit;

a plurality of sound inlets circumferentially spaced on said rear portion of said interference pipe, each of said inlets directly over said rearward sound terminal for direct transmission of sound waves to said rearward sound terminal, said inlets covered with a non-woven textile;

two rows of first openings spaced axially on said interference pipe, one of said rows 180° opposite the other of said rows on said interference pipe, each of said openings covered with a material for sound resistance;

a third row of openings positioned on said interference pipe 90° from one of said rows of first openings, each opening in said third row being elongated and covered with a second resistance material; and thereby resulting in a directional microphone having superior directional characteristics with lower wind noise and proximity effect.

* * * * *